United States Patent [19]

Stahlecker

[11] 4,192,129

[45] Mar. 11, 1980

[54] MOVABLE SERVICING DEVICE FOR A SPINNING MACHINE, ESPECIALLY AN OPEN END SPINNING MACHINE

[75] Inventor: Fritz Stahlecker, Bad Überkingen, Fed. Rep. of Germany

[73] Assignee: Hans Stahlecker, Fed. Rep. of Germany

[21] Appl. No.: 732,880

[22] Filed: Oct. 15, 1976

[30] Foreign Application Priority Data

Oct. 16, 1975 [DE] Fed. Rep. of Germany ..... 2546436
Jul. 15, 1976 [DE] Fed. Rep. of Germany ..... 2631791

[51] Int. Cl.[2] ..... D01H 15/00; D01H 11/00; D01H 13/14; D01H 1/12

[52] U.S. Cl. ..... 57/301; 57/263

[58] Field of Search ..... 57/34 R, 58.89–58.95, 57/52, 53, 54, 56, 78, 80, 81, 78, 79, 83, 261, 263, 300, 301, 302

[56] References Cited

U.S. PATENT DOCUMENTS

| | | | |
|---|---|---|---|
| 3,608,293 | 9/1971 | Brouwer | 57/261 X |
| 3,810,352 | 5/1974 | Miyazaki et al. | 57/263 |
| 3,858,385 | 1/1975 | Shinkai et al. | 57/263 |
| 3,950,926 | 4/1976 | Stahlecker | 57/263 |
| 4,043,106 | 8/1977 | Stahlecker | 57/263 |

*Primary Examiner*—Donald Watkins
*Attorney, Agent, or Firm*—Craig and Antonelli

[57] ABSTRACT

Servicing apparatus, such as rotor cleaning and yarn piecing apparatus, for servicing individual spinning assemblies of an open end spinning machine is provided. Operational disturbance responsive control equipment is provided for controlling the movement of the servicing apparatus to servicing positions at respective spinning assemblies where operational disturbances are detected. Step-by-step control equipment is also provided to control the servicing apparatus for sequential preventive maintenance servicing operations at the various spinning assemblies. In order to optimize preventive maintenance and disturbance response maintenance, a switch-over switch is provided for switching between the disturbance responsive control equipment and the step-by-step control equipment.

35 Claims, 8 Drawing Figures

MOVABLE SERVICING DEVICE FOR A SPINNING MACHINE, ESPECIALLY AN OPEN END SPINNING MACHINE

The invention relates to servicing apparatus for at least one spinning machine, which servicing apparatus includes a movable servicing means for performing servicing operations at respective spinning assemblies of the spinning machine. Particularly preferred embodiments of the invention relate to a servicing device that is displaceable along at least one spinning machine, especially an open end spinning machine, that is equipped with means for execution of a cleaning operation on a spinning assembly and for a piecing operation, as well as a device for displacement of the servicing device, for which a determining program control is provided to hold the device at the spinning assembly to be serviced and to execute the servicing operations.

To facilitate yarn piecing, especially in open end spinning assemblies that involve a relatively cumbersome servicing operation, a series of partly or entirely automatic devices is known, e.g., German Offenlegungsschrift No. 2,008,142 or German Auslegeschrift No. 2,012,108. In these constructions there is usually provision for the determination of a break in the yarn, whereupon the yarn piecing program begins. Since in most cases the cause of a yarn break is dirt, especially dirt in the spinning rotor, it is advantageous if there is a cleaning process that is run through in advance of the piecing operation.

The invention is addressed, at least in part, to the problem of making still more economical use of the servicing device of the mentioned type, and thereby at the same time improving the spinning output of the spinning machine that is to be serviced. For this purpose, this invention provides that the program control is selectively connectable via a switchover device to control means responsive to a disturbance in a particular spinning assembly, or to control means responsive to a step-by-step switching system.

With this arrangement, it is possible on the one hand to remove a disturbance that has already occurred (operation with disturbance responsive control means) and on the other hand, if necessary, to prevent potential disturbances (preventive maintenance with step-by-step control means). The point of departure here is that, particularly in open end spinning assemblies, the quality of yarn that is produced deteriorates after a foreseeable time, without the occurrence of a yarn break. Irregularities then appear in the spun yarn that lead in practice to an unwanted moiree effect. It is now possible by means of the invention to get uniformity of spinning quality by preventive cleaning of the spinning assembly, without thereby limiting the function of the displaceable servicing device that is supposed to allow maintenance of adequate production quantity.

The arrangement of the invention discussed above is directed to the idea that from the same servicing device both operational disturbances, e.g., a yarn break, can be eliminated, and also preventive servicing operations can be effected, which in some situations would prevent a disturbance of operation. Especially in the case of open end spinning machines such a process is advantageous, because it is known that the quality of the produced yarn deteriorates after a foreseeable time without actual occurrence of a yarn break. This reduction in quality leads to irregularities that make the further processing of the spun yarn difficult or impossible. The preventive servicing of the spinning assembly, especially cleaning of the spinning rotor, leads to an improvement of spinning quality.

A further development of the invention is addressed to the problem of developing a servicing device of the kind that has been mentioned, in such a way that the most uniform possible circulating times for the servicing device will be sustained, so that the time intervals in which the servicing device passes by the individual spinning assemblies will be as short and uniform as possible. Thereby it will be ensured that with preventive servicing of the spinning assembly at sufficiently brief intervals, there will be a monitoring of the individual spinning assemblies so that production quality will not be reduced, since then a disturbance will be quickly detected and eliminated.

To solve this problem, a control switch is provided for the switchover device that has an arrangement that switches over to the step-by-step control means after a path of determined length has been traversed, by the servicing device and that switches over to the disturbance responsive control means after a specific time.

With this last mentioned arrangement, a specific time segment is determined which is composed of a monitoring trip of a specific duration and a time segment necessary for preventive servicing, whereby the time for the preventive cleaning is lengthened or shortened as a function of the time needed for the monitoring trip. This means that if there are many operational disturbances, only a small portion of time will be taken for preventive servicing, whereas vice versa with a low number of operational disturbances, a greater portion of time will be available for preventive servicing.

In an advantageous embodiment of the invention, a switchover device is connected to a double throw switch, connected to a timer that emits a time-dependent switching pulse, and to a counter that determines the number of spinning assemblies that have been passed and emits an opposing switching pulse after passage of a predetermined number of assemblies. In this arrangement the control switch automatically decides the switchover direction before the start of a preventive servicing operation and how much time will be available for preventing servicing, whereafter the next monitoring trip must occur. The time needed for a total circuit can be kept almost uniform, so that the intervals will be kept almost uniform, in which the servicing device passes by the individual spinning assemblies.

In another advantageous arrangement of the invention, it is provided that a setting member of a comparison device engages the double throw switch, said setting member being connected with a timer that emits a signal which is a function of the time necessary for a specific path or for passing a specific number of spinning assemblies. In this arrangement the time required for a monitoring trip is compared with an average value, after which the duration of the preventive servicing is dependently determined, so that here also uniform circulating times are sustained.

In an advantageous embodiment of the invention it is provided that the switching time interval of the timer or of the timing member will be adjustable. Thereby the possibility is offered, for adaptation of the servicing device to values that occur because of a changed situation, e.g., if an extra open end spinning machine is to be included in the servicing unit, or if an adaptation to other fibrous materials for processing on the spinning machines is to be undertaken.

In a further embodiment of the invention, a detector is provided that determines the degree of filling up of the spools produced by the spinning assemblies. This detector is connected to the step switch so as to trigger or to prevent stopping of the travelling device independent of the filling up of the particular spool. In this way it is ensured that no preventive servicing will be done on a spinning assembly if there has just been a spool change and servicing of the spinning assembly occasioned thereby. It is also contemplated to exclude a preventive servicing if the spool is almost full, so that a spool exchange will have to occur, also associated with a servicing operation.

In a further embodiment of the invention, a detector is provided that checks the time since a previous servicing, which detector is connected to a step switch for the step-by-step preventive maintenance operation. With too short a time interval, halting at the spinning assembly in question is prevented. In this way it is ensured that there will not be preventive servicing of a spinning assembly in a short interval after servicing occasioned by operational disburbance.

In a further embodiment of the invention there is a memory provided that records the number of servicing operations of the individual spinning assemblies. In this way it is possible to make a judgement on the performance of the individual spinning assemblies or their tendency to disturbance. In practice it has been found that most disturbance-caused servicing, which may amount to as much as 90% of the cases, always occur on quite specific spinning assemblies, in the range of 20% of those being operated. In this way it is possible to determine which these spinning assemblies are, and possibly to institute changes so that the number of operational disturbances will be reduced.

These and further objects, features and advantages of the present invention will become more obvious from the following description when taken in connection with the accompanying drawings which show, for purposes of illustration only, several embodiments in accordance with the present invention.

DETAILED DESCRIPTION OF THE DRAWINGS

Figure 1:
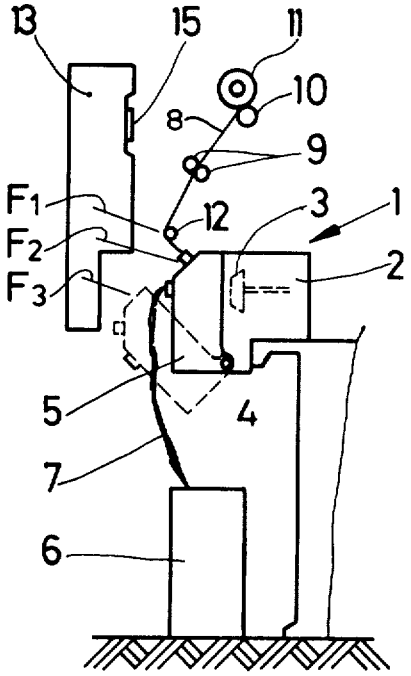
FIG. 1 is a schematic cross sectional view of an open end spinning machine with a first displaceable servicing device according to the present invention.
Figure 2:
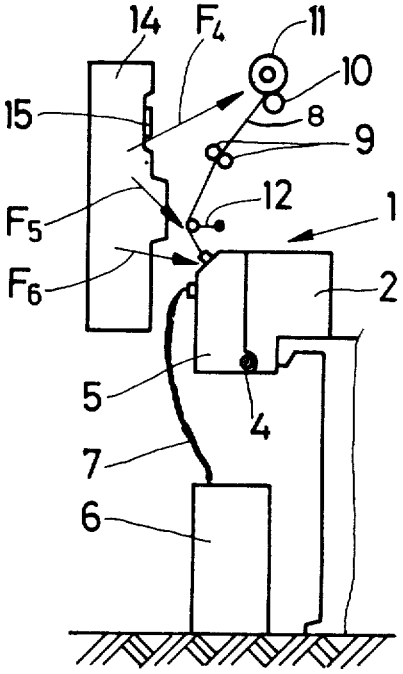
FIG. 2 is a schematic cross sectional view through an open end spinning machine with another displaceable servicing device according to the present invention.

The open end spinning machine that is very schematically shown in FIGS. 1 and 2 comprises a plurality of open end spinning assemblies 1, arranged next to each other. In the illustrated embodiment, spinning assemblies 1 respectively have a housing part 2 in which a spinning rotor 3, indicated by dashed lines in FIG. 1, is disposed. In a housing part 5 that is pivotable about a shaft 4, there are the necessary feed and opening means. A sliver 7 taken from a can 6 is delivered to the feed and opening device in housing part 5, where it is opened to form individual fibers and is conveyed to spinning rotor 3. In spinning rotor 3 the fibers are bound together to form a yarn 8 that is drawn off from draw rolls 9 and wound on a spool 11 by means of a winding roll 10. The yarn's presence is monitored by a yarn monitor 12. As FIG. 1 shows also, housing part 5 may be swung about its shaft 4 in such a way that spinning rotor 3 is accessible for cleaning.

A mobile servicing device is associated with the open end spinning machine, constituted by two instruments 13 and 14 that can be moved together or independently, that can be respectively introduced for themselves to execute a servicing operation. Part instrument 13 of the servicing device does the cleaning of the open end spinning assembly, especially the rotor. For this, the said instrument 13 is equipped with various function elements, indicated only schematically by arrows F1, F2 and F3. Function element F1 interrupts sliver delivery by actuating yarn monitor sensor 12, function element F3 swings housing part 5 down, and function element F2 then cleans spinning rotor 3. The inclusion of other supplementary function elements are also contemplated by the present invention such as those that clean an opening roll (not illustrated) or suck off dirt or the like. Part instrument 14 of the servicing device then includes function elements that effect the actual piecing process after a cleaning operation. For this instrument 14 is equipped with a function element F4 that lifts spool 11 from winding roll 10 for the piecing process, seeks the yarn end and winds it again against the normal direction of winding. The yarn end is then advantageously prepared inside instrument 14 and led back via a function element F5 against the normal draw-off direction into spinning rotor 3, there pieced to a filament ring and again drawn off. Still other function elements are provided such as function element F6 that controls the sliver speed during the piecing. The details of the part instruments 13 and 14 for carrying out the indicated servicing operations are not included herein in order not to obscure the present invention and since those skilled in the art can practice the invention given this disclosure and the state of the art.

Part instruments 13 and 14 are provided with detectors 15 that can receive signals from transmitters (not illustrated) associated with the respective spinning assemblies 2 which indicate the need for a cleaning operation. This signal transmission is advantageously controlled via yarn monitor 12, which in the presence of a yarn break interrupts sliver feed 7 and then triggers a suitable signal. Detectors 15 and the associated signal transmitters can be constructed to work mechanically, optically, acoustically or electrically. Upon reception of a signal indicating that a spinning assembly 2 requires servicing, a program is triggered from detector 15, with which program the holding and aligning of instruments 13 or 14 and the subsequent running of the servicing operations is controlled. The described servicing process also includes cases in which the individual spinning assemblies are equipped with instruments that effect a control of the spun yarn and stop spinning assembly 2 as soon as the yarn no longer has its predetermined quality.

Devices of this kind for yarn quality monitoring are cumbersome and expensive. On the other hand, it has been found in practice that the deterioration of yarn quality only occurs after a specific duration of operation, so that this quality deterioration can be offset in some situations where even before the occurrence of a yarn break there is a cleaning operation after a specific period of operation, for which the spinning assembly in question is brought to a standstill and a piecing operation then has to be effected. To make this socalled preventive cleaning possible, part instruments 13 and 14 are each provided with a step-by-step switching system that is connected ahead of the program control and, independently of any yarn break, moves part instruments 13 and 14 to a spinning assembly 2, there to execute these servicing operations. Here function element F1 of part instrument 13 is very appropriate: with it an artificial yarn break is tripped, by interruption of the sliver feed. Part instrument 14 which follows part instrument 13 then encounters a spinning assembly with a yarn break. It is immaterial to this instrument 14, whether the yarn break was caused by operational disturbance or artificially.

Figure 4:
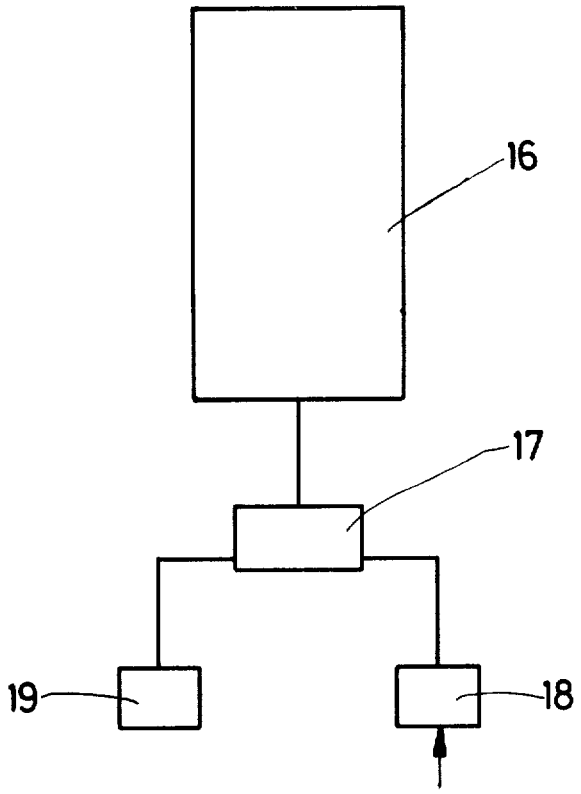
FIG. 4 is a schematic block diagram depicting control apparatus for a servicing device constructed according to a preferred embodiment of the present invention.

In FIG. 4 there is a block diagram that schematically shows program control 16, with which one or both part instruments 13 and 14 of the servicing device are triggered, i.e., stop at a spinning assembly 2, align and execute a servicing operation. A double throw switch 17 is connected ahead of this program control 16, that selectively connects program control 16 with a control device 18 for determining a disturbance in a spinning station, especially a yarn break, or with a step-by-step switching system 19. Double throw switch 17 may be a mechanical or an electric switch that reacts to mechanical, acoustic, optical, or electric signals and switches over correspondingly. When switch 17 connects program control 16 with detector 18, the device for servicing makes a monitoring trip, in the course of which it is only active if the detector has found an irregularity, especially a break in the yarn. If on the contrary, double throw switch 17 connects program control 16 to the step-by-step switching system 19, the servicing device performs preventive servicing operations, i.e., it is associated with a spinning assembly 2 whether or not there is a disturbance such as a yarn break. Step-by-step switching system 19 may be so designed according to the invention so that it does not service successive spinning assemblies but, for example, only every second or third assembly or the like.

Care has to be taken to be sure that appropriate switchovers between the two different monitoring and servicing functions occur. The starting point can be that in most instances it would not be appropriate to provide just servicing operations for a complete circuit of the servicing device because these preventive servicing operations at all spinning stations would last a rather long time, in which there would be no monitoring of the other spinning stations for operational disturbances. This could entail a substantial drop in production because there would then be the danger that individual spinning stations would halt for relatively long periods.

Figure 3:
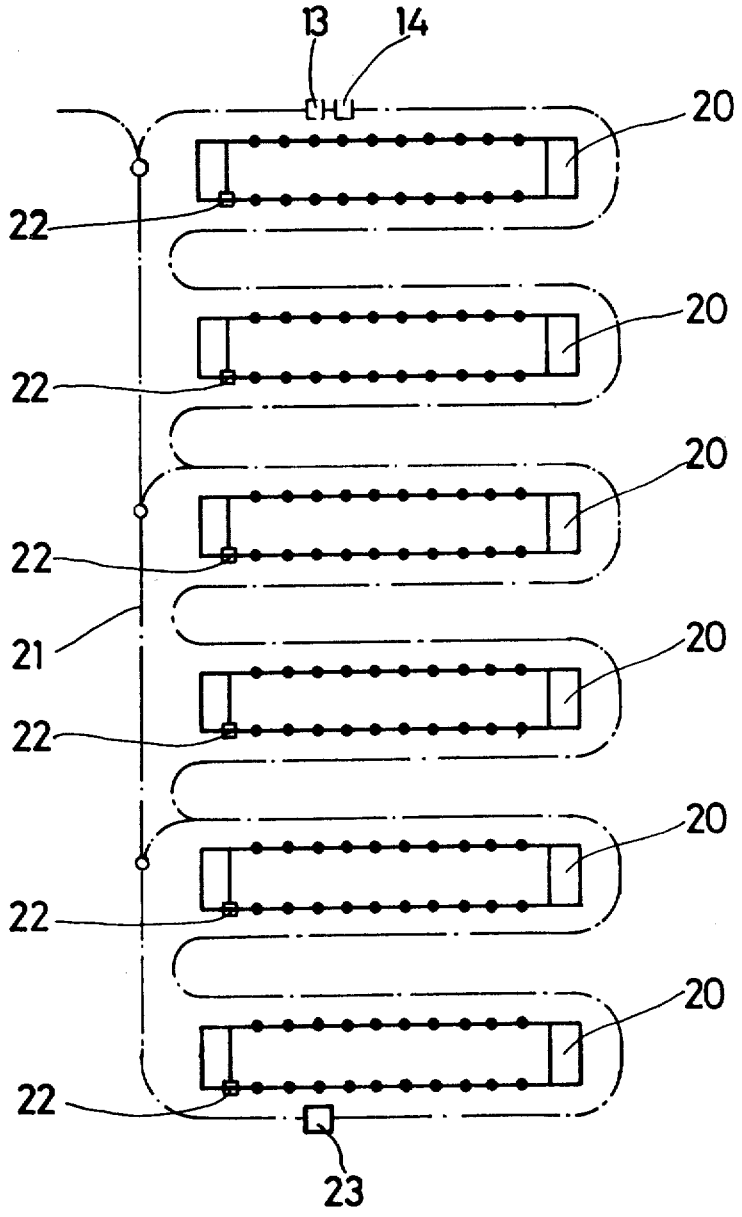
FIG. 3 is a top schematic view of a group of open end spinning machines with servicing devices constructed in accordance with the present invention.

In FIG. 3 there is a schematic top view of the arrangement of a plurality of spinning machines 20, especially open end spinning machines to which a common track 21 for the servicing instrument or device is associated, said instrument comprising the two part instruments 13 and 14. As already noted, part instrument 13 performs operations, particularly the cleaning of the open end spinning assembly, while the following part instrument 14 performs subsequent service operations, especially the piecing of the yarn. It is also contemplated to couple the two part instruments 13 and 14 so that they can be moved together, or they can be furnished with their own travel mechanisms so that they can be associated simultaneously with different spinning assemblies and operate there independently.

To effect the switchover from monitoring as such to preventive servicing, double throw switch 17 may be actuated by a timing switch according to preferred forms of the invention. In this case it can be arranged that servicing device 13, 14 will circulate for a specified time with active detector 18 and then be switched over as a function of time to step-by-step switching system 19 which then effects preventive cleaning or servicing. Here the base value can be the time required for a complete circuit plus a given number of servicing operations, according to which the time will then be determined in which a preventive servicing or cleaning is to be executed. In this way it will be pretty well ensured that in the course of time all spinning assemblies 2 of all spinning machines 20 will undergo a preventive cleaning or servicing.

A more precise operation is also contemplated where the servicing device 13, 14 is equipped with at least one counter that counts the number of spinning assemblies 2 passed by servicing device 13, 14. For this there is provided a cogwheel on one or both of part instruments 13 or 14, which would be advanced by one division by a spindle or the like of the respective spinning stations. It can then be further provided according to the invention that the counter will switch over the double throw switch 17 from detector 18 to the step-by-step switching system, if the servicing instrument 13, 14 has passed a specific number of open end spinning assemblies, which corresponds for example to the number of one or more complete circuits on track 21. Step-by-step switching system 19 ensures execution of a preventive servicing or cleaning at a specific number of spinning assemblies. Here it may be provided that for example five spinning assemblies will be given a preventive cleaning whereafter the counter of double throw switch 17 will be reset so that detector 18 will be actuated. A switchover to the step-by-step switching system 19 would then only occur again after a predetermined number of circuits. Here it may be provided that the preventive cleaning will not be done at successive spinning stations but for example at every second or third one, etc. It is also contemplated to provide a preventive cleaning on one side of the machine, or only on one section of open end spinning machine 20. The open end spinning machines 20 must then be furnished with devices that report to the servicing instrument 13, 14 which of spinning assemblies 2 must be provided for the next preventive cleaning. As in the case of a counter, a way of operating is preferebly developed in which the path travelled over by servicing device 13, 14 is measured.

In many cases it is advantageously provided that if, for the switchover of the double throw switch 17, there is a combination of a timing switch system and a counter or path-measuring device. For example, after a specific operating time there can be a switchover to a preventive cleaning which is then sustained only for a specific number of spinning assemblies, whereafter there follow one or more circuits in which there is monitoring only.

For practical operation according to other preferred embodiments, it is further advantageously provided that the spinning machine 20 by which servicing instrument 13, 14 passes itself determines what kind of servicing is to be done, i.e. whether only the presence of the yarn is to be monitored, or if at one or more of all spinning stations there should be preventive cleaning. For this case an actuating element 22 schematically indicated in FIG. 3 can be disposed in the region of the entrance to spinning machine 20, which actuates double throw switch 17. This actuating element can function mechanically, acoustically, optically or electrically, and set the correspondingly constructed switch. The actuating element on the individual spinning machines can be controlled in turn by a timing switch, a counter or an auxiliary device that monitors the operating state of spinning machine 20. If a timing switch system is provided, this sets the actuating element after a specific operating time in such a way that the latter would actuate double throw switch 17, so that when servicing device 13, 14 entered track 21 in the region of the spinning machine in question, there would be a switchover from detector 18 to step-by-step switching system 19 in order that there would be a preventive cleaning operation. Similarly, a counter could be provided that would always be shifted by one division as the servicing device 13, 14 passed the open end spinning machine. This counter could then switch over the actuating element after the fifth circuit with the active detector where there was monitoring only, so that double throw switch 17 would go over to step-by-step switching system 19. Acutating element 22 can also be connected to a monitoring device of spinning machine 20 that monitors yarn quality of the individual spinning assemblies, for example, or counts the number of yarn breaks in a specific unit of time and transmits to the actuating element. If the yarn quality becomes too unsatisfactory at a specific number of spinning assemblies, or if there is an excessive number of yarn breaks, the actuating element would then have to be adjusted in such a way that it would switch over the double throw switch to step-by-step switching system 19 upon entrance of servicing device 13, 14.

To attain the same goal, a travelling inspection instrument 23 can also be provided according to another feature of the invention that travels ahead of servicing element 13, 14. This inspection instrument determines the operating state of the individual spinning machines 20 and transmit a signal to actuating element 22 as it leaves the spinning machine 20 in question, which then actuates double throw switch 17 so that the most appropriate servicing operation will be executed by servicing device 13, 14. This inspection device could be, for example, a simple travelling yarn break counter that in its travel around a spinning machine counts the number of spinning assemblies on which there is a yarn break, and transmits an appropriate signal to actuating element 22 as it leaves spinning machine 20. This signal can be given mechanically, acoustically, optically or electrically.

In the embodiments of FIGS. 5 to 8 described below, the basic spinning assembly apparatus and servicing devices are similar to those described above in conjunction with FIGS. 1 and 2. In order to more clearly describe the control apparatus of those embodiments of FIGS. 5 to 8 and distinguish same from the control apparatus of the embodiments of FIGS. 3 and 4, certain corresponding reference numerals, raised by adding "100" thereto, are included in FIGS. 5 to 8.

Figure 5:
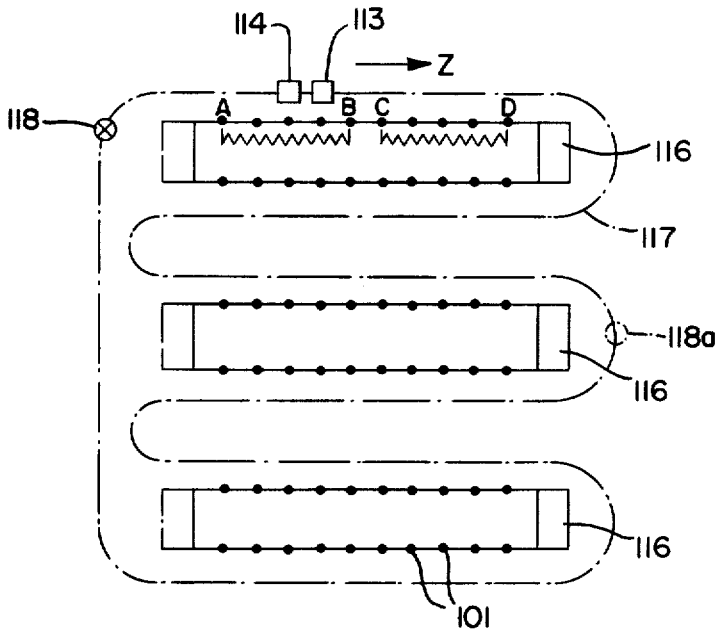
FIG. 5 is a top schematic view of a group of open end spinning machines associated with a servicing unit, with a bipartite servicing device, arranged according to another embodiment of the invention.

In FIG. 5 there is a schematic top view of an arrangement of three open end spinning machines 116 to which there is associated a common track 117 for the servicing instrument, which consists of two part instruments 113 and 114. As already mentioned for part 13 above, part instrument 113 performs preparatory operations, especially the cleaning of open end spinning assemblies 101 while part instrument 114 that follows immediately executes subsequent operations, especially yarn piecing. In this way it is also contemplated in certain embodiments to connect the two part instruments 113 and 114 with each other so that they can travel together or have their own means for travelling, so that simultaneously they may be associated with different spinning assemblies 101 and do indepentdent operations there.

At point A for instance the servicing device runs freely to the upper open end spinning machine 116 in the drawing, and beings a monitoring trip in which there are servicing operations only if there is operative disburtance on a spinning assembly, so that a corresponding signal acts on detector 115, triggering a halt and execution of the servicing operation. After a complete circuit, if the servicing device 113, 114 has returned to point A, a preventive servicing is again begun, in which a specific number of open end spinning assemblies are serviced whether or not there is a disturbance between A and B, until at point B there is a switchover to another monitoring trip. In this way gradually all open end spinning assemblies of machine 116 that are combined as one service unit by track 117 are engaged.

In practice there are certain difficulties because the number of servicing operations to remove operational disturbances during one circuit is not constant, and not predictable either. This means that the servicing device 113, 114 needs different lengths of time for the individual circuits. For example it can happen that a group of open end spinning assemblies may almost simultaneously have filled spools so that then on these assemblies there will be a spool change, with an associated servicing operation. If with these, a number of servicing operations to remove operational disturbances is associated with the preventive servicings, the time needed for one circuit would be quite long. This could have the effect that an interruption of operation of individual spinning assemblies or of several of them would go undetected over a rather long period, and not be eliminated by servicing instrument 113, 114. This could lead to a considerable drop in production. To avoid this danger, the effort is made according to the invention to keep the total circuit times, i.e., of monitoring trips and preventive servicing operations, within a specific time span. It is provided that the preventive servicing operations will then be reduced, i.e., fewer spinning assemblies will be preventively serviced, if the monitoring trip takes quite a while because a larger number of operational disturbances have to be eliminated, whereas in the reverse situation, a greater number of assemblies would receive preventive servicing.

Figure 6:
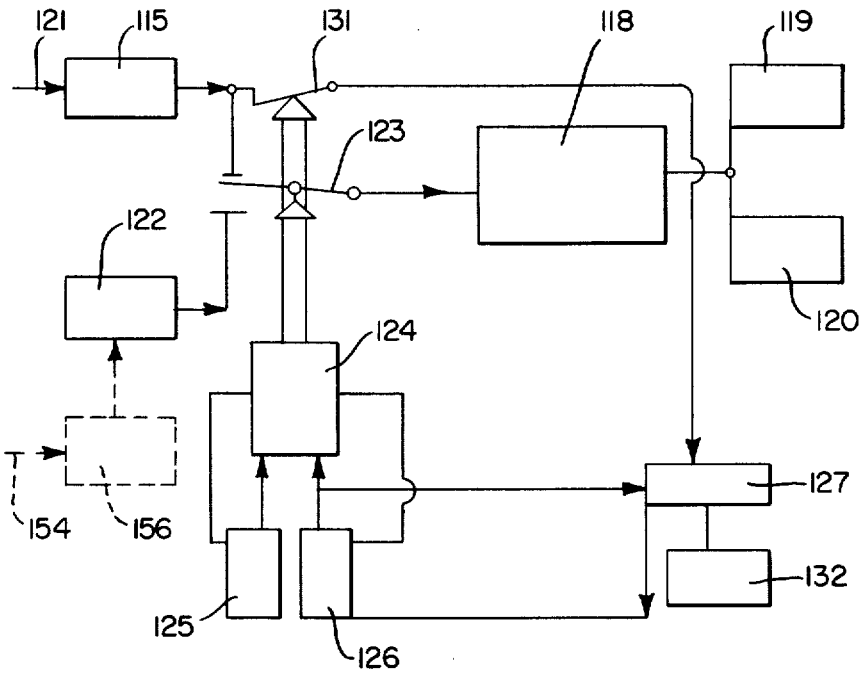
FIG. 6 is a schematic block diagram depicting control apparatus for a servicing device constructed according to a further preferred embodiment of the present invention.

An embodiment of a circuit for production of uniform circulation times is shown in the block diagram of FIG. 6. Servicing device 113, 114 is provided with a program control 118 that is connected on the one hand with the drives 119 of function elements F that perform the servicing operations, and on the other hand with drive 120 of a travelling device. Program control 118 itself is started either by a signal from detector 115 that receives signals 121 from the individual spinning assemblies, or from a step switch 122. The switchover to the type of servicing (that is required) is effected via a switchover device that has a double throw switch 123 which selectively connects detector 115 or step switch 122 with program control 118. Double throw switch 123 is connected with a switching element 124 that advantageously is made as a flip-flop, to which switchover the signal of a timer 125 or a counter 126 is applied. Timer 125 is made in such a way that after a specific interval it emits a signal to switch 124, while counter 126 sends a signal to switch 124 after passage of a specific number of open end spinning assemblies. Timer 125, that establishes the connection with detector 115, and counter 126 that connects program control 118 with the step switch, are so adapted to each other that constant circulation times result for a monitoring trip and preventive servicing.

For example, counter 126 is so designed that it emits a switching pulse if servicing device 113, 114 has completed a whole circuit, i.e. for example from point A to point A of FIG. 5. This means that then servicing device 113, 114 upon reaching point A after a first circuit will be switched over to step switch 122 so that there will be preventive servicing. Timer 125 is so designed that a signal is emitted from it after a time interval that constitutes the time necessary for the circuit from A to A, including execution of servicing operations evoked by operational disturbances and including the time needed for preventive servicing of a zone from A to B, based on an average value as determined experimentally. This means that theoretically there is a switchover of the servicing device to detector 115 when point B is reached. If it should happen that there are less operational disturbances than would have been anticipated, there is a longer period of preventive servicing, i.e., spinning assemblies are serviced that are beyond the zone from A to B. If there should be a multiplicity of servicing operations because of operational disturbances, then timer 125 would emit its switchover signal before servicing device 113, 114 reached point B. This means that because of the longer time involved, for the monitoring trip, the preventive servicing operations portion would be reduced.

In this arrangement, it is to be observed that the design of timer 125 is such that the time span that affects the switching pulse is long enough so that the switching pulse will not occur before completion of a circuit, because in this case there can be no switching over of switch 124 before this element has been tripped by the pulse from counter 126. This would also be excluded, for example, by having the number of servicing operations for elimination of operational disturbances stored in a memory 127 that receives signals from detector 115. This memory 127 then transmits a signal to counter 126, that upon reaching the governing number of operational disturbances for the design of the time span will suppress the signal of the counter. This would result in a situation where, after a complete circuit, there would be no preventive servicing but rather a new monitoring trip would be started. In such a case it would be advantageous if timer 125 and counter 126 would also send a switching signal with any multiple of the value that is set on them. Advantageously both timer 125 and counter 126 would be connected with switch 124 in such a way that with switching of switch 124 both timer 125 and counter 126 would be started.

Figure 7:
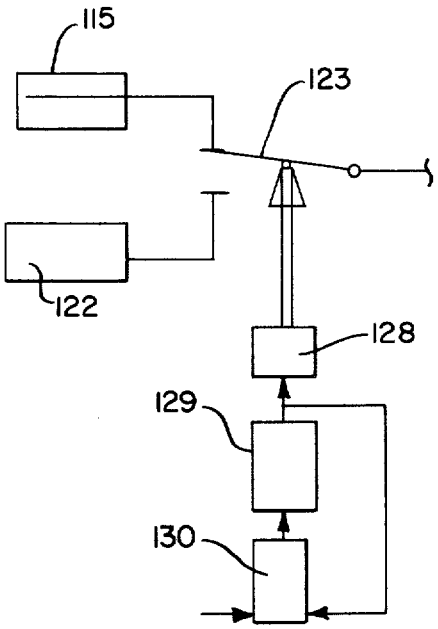
FIG. 7 is a partial schematic block diagram as in FIG. 4, depicting another embodiment of the present invention.

In the embodiment of FIG. 7 there is a modified control switch for double throw switch 123 that connects detector 115 or step switch 122 with the program control 118 of servicing device 113, 114. A setting member 128 is connected with switch 123, controlled by an electronic comparison device 129. Electronic comparison device 129 receives signals from a chronometer 130. Chronometer 130 measures the time needed for the last preventive servicing segment and the subsequent type of servicing. A signal that is a function of this time is applied to the electronic comparison device 129, which compares this signal with a value stored in it, corresponding to an average time interval. Depending upon the result of the comparison, the electronic comparison device 129 determines by signal to setting member 128 if and for how long a preventive servicing is to be conducted, by switching over to step switch 122. If it has resulted that the monitoring trip lasted longer than the average, the preventive servicing is correspondingly curtailed. If it has been shown that on the contrary the monitoring trip was completed more quickly than would have been anticipated, because there were less operational disturbances than on the average, then the preventive servicing will be extended to several spinning assemblies. The signal with which the electronic comparison device actuates the setting member 128 so that double throw switch 123 will again be connected with detector 115 is advantageously transmitted as a start signal to chronometer 130.

To give chronometer 130 the possibility of determining the time needed for a circuit, there is advantageously in this embodiment a counter or a path measuring device that sends suitable signals to chronometer 130 when it has passed over a specific distance.

Of course it is contemplated in the embodiments of FIGS. 6 or 7 to design the path segments and the times not for a whole circuit by servicing device 113, 114 about the entire service unit, but to have other divisions.

In practice it is advantageous if it is arranged so that there will not be a preventive servicing on a spinning assembly on which there was a servicing operation just before to eliminate an operational disturbance, on the very next circuit because in general this would be unnecessary and it would have a poor economic result. Similarly, it is not very acceptable to do preventive servicing if it can be foreseen that an operational disturbance, or particularly a spool change, will occur on a spinning assembly that would also make servicing necessary. For this reason, it is advantageously provided that a signal transmitter on the spinning assembly and a detector on the servicing device determine that there has been an operation-caused servicing operation shortly before and/or that in a short time an operation-caused servicing will be necessary.

Figure 8:
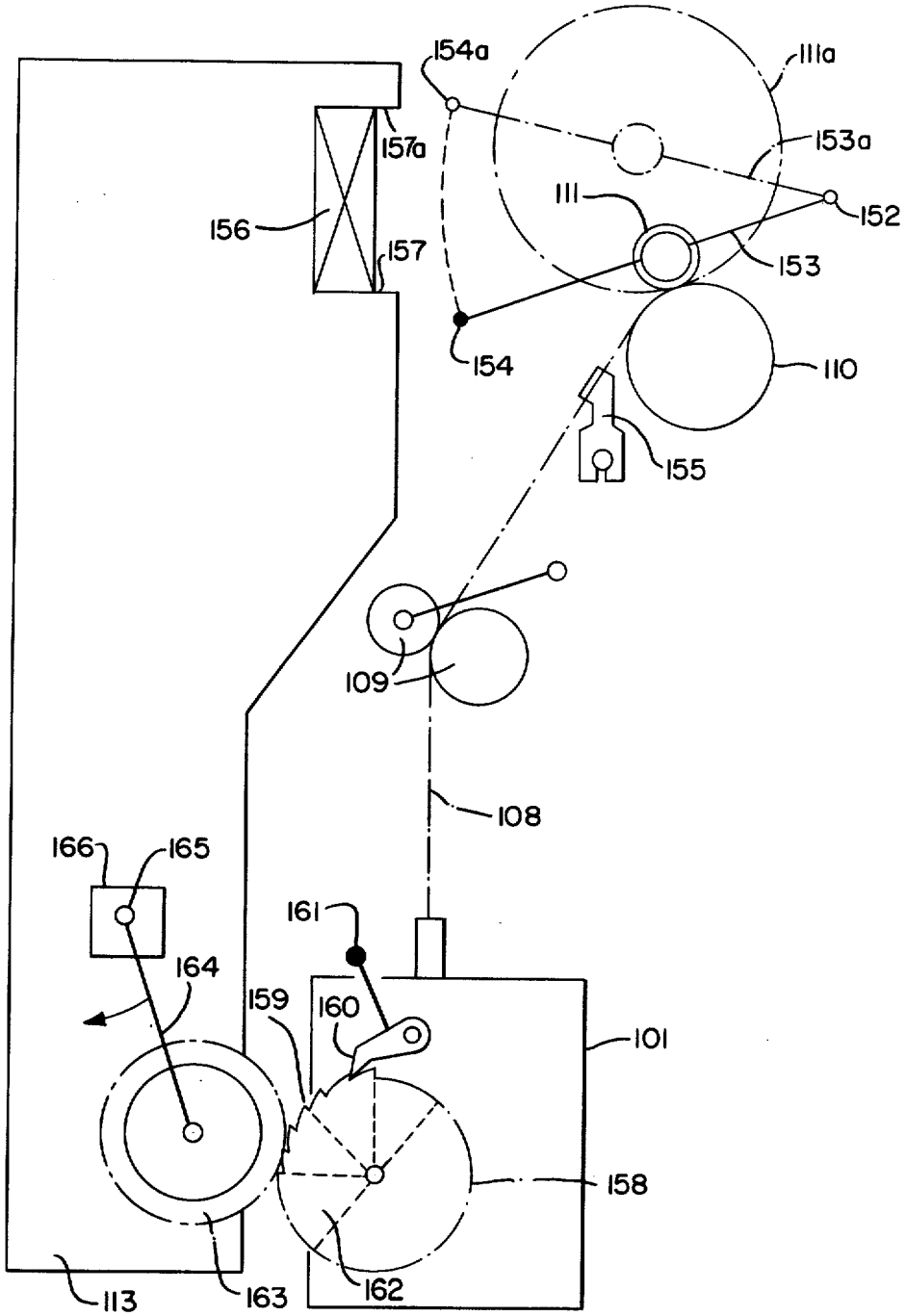
FIG. 8 is a cross sectional schematic view of an open end spinning machine with part of a servicing device that assumes an additional function in accordance with another embodiment of the present invention.

The case caused by a spool change can be determined by means of the arrangement corresponding to FIG. 8. As a function of the degree of filling up spool 111, spool holder 153 that accepts the spool and pivots about a shaft 152 assumes different angular positions. If for example there is a signalling device 154 at its end, this assumes different positions with reference to a detector 156 disposed on servicing device 113, 114. The detector is so designed that it can only detect signalling device 154 if it moves into a middle zone, i.e. spool 111 has a minimal filling or has not yet reached a maximum filling. In the illustrated embodiment, this means that signalling device 154 must be between limits 157 and 157*a* of detector 156, to be detected. Detector 156 can be connected directly with step switch 122, as indicated in dashed lines in FIG. 6. It is then so arranged that when there is no signal from detector 156, step switch 122 sends a signal to program control 118 such that the travelling device will not stop at the spinning assembly in question.

Similarly, it can also be determined that a servicing operation has been done on a spinning assembly, not caused by a spool change but by another operational disturbance. For example, signalling device 154 can be made as a lamp or the like that is switched off in execution of an operation-conditioned servicing, and that has a time switch that allows switching on only after the lapse of a specified running time. A special detector with a special signalling device can also or alternatively be provided to determine this situation according to the invention.

In practice as also mentioned above with respect to the embodiments of FIGS. 3 and 4, operational disturbances are not simultaneously distributed over all spinning assemblies, but they are rather caused by quite specific assemblies which for some reason or other are not satisfactorily constructed. To determine which spinning assemblies these are, it is provided that there will be determination of the number of operational disturbances on the individual spinning assemblies. For this, memory 127 can be used, connected with detector 115. In the connecting line to storage 127, a switch 131 is advantageously incorporated, being actuated by switchover device 124 so that there will only be a connection between the detector and storage 127 if the detector also transmits its signal further to program control 118. The preventive servicing operations are then not recorded by storage 127. Storage 127 is also advantageously connected to counter 126 in such a way that signals coming from detector 115 will be associated with the spinning assembly engaged by the counter. It is then possible to interrogate memory 127 and to obtain data by means of a printer 132 or other indicator. It can also be provided that an indexing member will actuate an indicator disposed on each spinning assembly.

A simple possibility for detection of a tendency to disturbance in a spinning assembly is shown in FIG. 8 where there is no use of a storage device. On spinning assembly 101 there is a dial 158 divided into separate characterizing sectors 162. The dial is loaded clockwise by a turning spring (not illustrated) and secured by a catch 160 which if required can be released by handle 161. The mobile servicing device 113, 114 has a ratchet 163 that is associated with teeth 159 of dial 158, said ratchet 163 being swingable on an arm 164 about a shaft 165. The drive of arm 164 and the drive of ratchet wheel 163 can be controlled by program control 118 (in a manner that is not specifically illustrated but only schematically indicated) if there is a signal from detector 115 that differs from the signals of step switch 122. With each servicing that is caused by operational disturbance, dial 158 will then be turned for example by one tooth so that it later can be simply read off, how many disturbance caused servicing operations took place on the spinning assembly. It is also contemplated in the zone of shaft 165 to dispose an indexing device 166 that is controlled as already indicated from storage 127.

While I have shown and described several embodiments in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

What is claimed is:

1. Servicing apparatus for at least one spinning machine comprising:

servicing means for servicing spinning assemblies of a spinning machine, moving means for moving said servicing means to respective servicing positions adjacent the respective spinning assembly to be serviced, disturbance responsive control means for controlling said moving means to move said servicing means to a servicing position adjacent a spinning assembly in response to detection of an operational disturbance at said spinning assembly, whereby those spinning assemblies exhibiting an operational disturbance can be serviced, step-by-step control means for controlling said moving means to move said servicing means to respective servicing positions adjacent respective spinning assemblies in a predetermined sequence, where preventive maintenance servicing operations can be carried out by said servicing means, and switchover means for switching control of said moving means between said disturbance responsive control means and said step-by-step control means.

2. Servicing apparatus according to claim 1, wherein said spinning assemblies are open end spinning assemblies, and wherein said servicing means includes cleaning means for cleaning portions of said spinning assemblies.

3. Servicing apparatus according to claim 1, wherein said spinning assemblies are open end spinning assemblies, and wherein said servicing means includes yarn piecing means for performing yarn piecing operations at said spinning assemblies.

4. Servicing apparatus according to claim 2, wherein said servicing means further includes yarn piecing means for performing yarn piecing operations at said spinning assemblies.

5. Servicing apparatus according to claim 1, wherein said switchover means includes a double throw switch for switching between said disturbance responsive control means and said step-by-step control means.

6. Servicing apparatus according to claim 5, wherein said switchover means further includes a timing switch system for controlling the operation of the double throw switch as a function of time elapsed.

7. Servicing apparatus according to claim 5, wherein the switchover means includes a path-switching path-measuring device for controlling the operation of the double throw switch as a function of the distance travelled by the servicing means.

8. Servicing apparatus according to claim 6, wherein the switchover means includes a counter for counting the number of spinning assemblies passed by said servicing means and for controlling the operation of the double throw switch as a function of the number of spinning assemblies passed by said servicing device.

9. Servicing apparatus according to claim 5, wherein the switchover means includes a counter for counting the number of spinning assemblies passed by said servicing means and for controlling the operation of the double throw switch as a function of the number of spinning assemblies passed by said servicing device.

10. Servicing apparatus according to claim 6, wherein the switchover means includes a path-switching path-measuring device for controlling the operation of the double throw switch as a function of the distance travelled by the servicing means.

11. Servicing apparatus according to claim 10, wherein the switchover means includes a counter for counting the number of spinning assemblies passed by said servicing means and for controlling the operation of the double throw switch as a function of the number of spinning assemblies passed by said servicing device.

12. Servicing apparatus according to claim 1, wherein said switchover means includes an actuator element on the spinning machine, said actuator element being responsive to operating data of the spinning machine and including means for controlling the switching between said control means as a function of said operating data.

13. Servicing apparatus according to claim 5, wherein said switchover means includes a movable actuator element on said spinning machine, said actuator element being movable in response to operating data of said spinning machine and including means for controlling the double throw switch.

14. Servicing apparatus according to claim 12, wherein said actuator element is connected with a time responsive switching system.

15. Servicing apparatus according to claim 13, wherein said actuator element is connected with a time responsive switching system.

16. Servicing apparatus according to claim 13, wherein said actuator element is connected to and controlled by a device which monitors disturbances of individual spinning assemblies.

17. Servicing apparatus according to claim 13, wherein said switchover means includes a mobile inspection system for monitoring the status of individual spinning assemblies and for controlling said double throw switch in response to detected conditions.

18. Servicing apparatus according to claim 1, wherein said servicing means includes at least two separate servicing devices, said separate servicing devices including operational function groups that are independently capable of operation.

19. Servicing apparatus according to claim 1, wherein said switchover means includes:

travel path responsive means for switching to said step-by-step control means in response to traversal of a predetermined travel path by said servicing means, and time responsive means for switching to said disturbance responsive control means after a predetermined time interval.

20. Servicing apparatus according to claim 19, wherein said switchover means includes a double throw switch for switching between said step-by-step control means and said disturbance responsive control means, wherein said time responsive means includes a timer which transmits a time dependent switching pulse to said switchover means, and wherein said travel path responsive means includes a counter which determines the number of spinning assemblies passed by said servicing means and, after a predetermined number are passed, emits an opposite switching pulse to said switchover means.

21. Servicing apparatus according to claim 19, wherein said switchover means includes a double throw switch for switching between said step-by-step control means and said disturbance responsive control means, and wherein a setting member controlled by a comparison device engages the double throw switch, said setting member being connected with a chronometer that transmits a signal that is a function of the time needed for said servicing means to traverse a specific path or pass a specific number of spinning assemblies.

22. Servicing apparatus according to claim 20, wherein the counter which counts the spinning assemblies that are passed serves as the device for detecting the preselected path and for switching over to the step switch, said counter being connected to the timer for switching back to its initial value.

23. Servicing apparatus according to claim 20, wherein the switching time of the timer is adjustable.

24. Servicing apparatus according to claim 21, wherein the chronometer is adjustable.

25. Servicing apparatus according to claim 19, wherein said switchover means includes a spool filling detector which detects the amount of filling up of spools produced by the respective spinning assemblies, said spool filling detector being connected to the step-by-step control means in such a manner as to trigger or prevent halting of the servicing means at a particular spinning assembly in dependence on the amount of filling up of the spool at said particular spinning assembly.

26. Servicing apparatus according to claim 20, wherein said switchover means includes a spool filling detector which detects the amount of filling up of spools produced by the respective spinning assemblies, said spool filling detector being connected to the step-by-step control means in such a manner as to trigger or prevent halting of the servicing means at a particular spinning assembly in dependence on the amount of filling up of the spool at said particular spinning assembly.

27. Servicing apparatus according to claim 21, wherein said switchover means includes a spool filling detector which detects the amount of filling up of spools produced by the respective spinning assemblies, said spool filling detector being connected to the step-by-step control means in such a manner as to trigger or prevent halting of the servicing means at a particular spinning assembly in dependence on the amount of filling up of the spool at said particular spinning assembly.

28. Servicing apparatus according to claim 19, wherein said switchover means includes an elapsed time detector which detects the time elapsed since a previous servicing operation at the respective spinning assemblies, said elapsed time detector being connected to the step-by-step control means in such a manner as to prevent halting of the servicing means at a particular spinning assembly if the time interval since the last servicing operation at the particular spinning assembly is shorter than a predetermined time interval.

29. Servicing apparatus according to claim 20, wherein said switchover means includes an elapsed time detector which detects the time elapsed since a previous servicing operation at the respective spinning assemblies, said elapsed time detector being connected to the step-by-step control means in such a manner as to prevent halting of the servicing means at a particular spinning assembly if the time interval since the last servicing operation at the particular spinning assembly is shorter than a predetermined time interval.

30. Servicing apparatus according to claim 21, wherein said switchover means includes an elapsed time detector which detects the time elapsed since a previous servicing operation at the respective spinning assemblies, said elapsed time detector being connected to the step-by-step control means in such a manner as to prevent halting of the servicing means at a particular spinning assembly if the time interval since the last servicing operation at the particular spinning assembly is shorter than a predetermined time interval.

31. Servicing apparatus according to claim 1, wherein memory means are provided for recording the number of servicing operations performed at the individual spinning assemblies.

32. Servicing apparatus according to claim 20, wherein memory means are provided for recording the number of servicing operations performed at the individual spinning assemblies.

33. Servicing apparatus according to claim 21, wherein memory means are provided for recording the number of servicing operations performed at the individual spinning assemblies.

34. Servicing apparatus according to claim 31, wherein said memory means is connected with a counter and a dial is associated with one or more indicators.

35. Servicing apparatus according to claim 34, wherein an indicator device is disposed on each spinning assembly, said indicator device being connectible with a setting dial.

* * * * *